United States Patent [19]

Berry et al.

[11] Patent Number: 4,846,861

[45] Date of Patent: Jul. 11, 1989

[54] CRYOGENIC REFRIGERATOR HAVING A REGENERATOR WITH PRIMARY AND SECONDARY FLOW PATHS

[75] Inventors: Robert L. Berry, Rancho Palos Verdes; Samuel G. Siciliano, San Pedro, both of Calif.

[73] Assignee: Hughes Aircraft Company, Los Angeles, Calif.

[21] Appl. No.: 191,095

[22] Filed: May 6, 1988

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,218,815 | 11/1965 | Chellis et al. | 62/6 |
| 3,303,658 | 2/1967 | Chellis | 62/6 |
| 3,877,239 | 4/1975 | Leo | 62/6 |
| 3,913,339 | 10/1975 | Berry | 62/6 |
| 3,969,907 | 7/1976 | Doody | 62/6 |
| 4,078,389 | 3/1978 | Bamberg | 62/6 |
| 4,092,833 | 6/1978 | Durenec | 62/6 |
| 4,365,982 | 12/1983 | Durenec | 62/6 |
| 4,366,676 | 1/1983 | Wheatley et al. | 62/6 |
| 4,397,156 | 8/1983 | Heisie et al. | 62/6 |

*Primary Examiner*—Ronald C. Capossela

*Attorney, Agent, or Firm*—Terje Gudmestad; A. W. Karambelas

[57] ABSTRACT

A cryogenic refrigerator is disclosed having a displacer with a regenerator therein. The regenerator opens at one end to a warm volume and at the other end to a cold volume. The opening at the cold volume includes an end hole and a plurality of radial holes. The radial holes serve as secondary passageways should the end hole become blocked with contaminants. The life of the cryogenic refrigerator is thereby greatly enchanced.

30 Claims, 1 Drawing Sheet

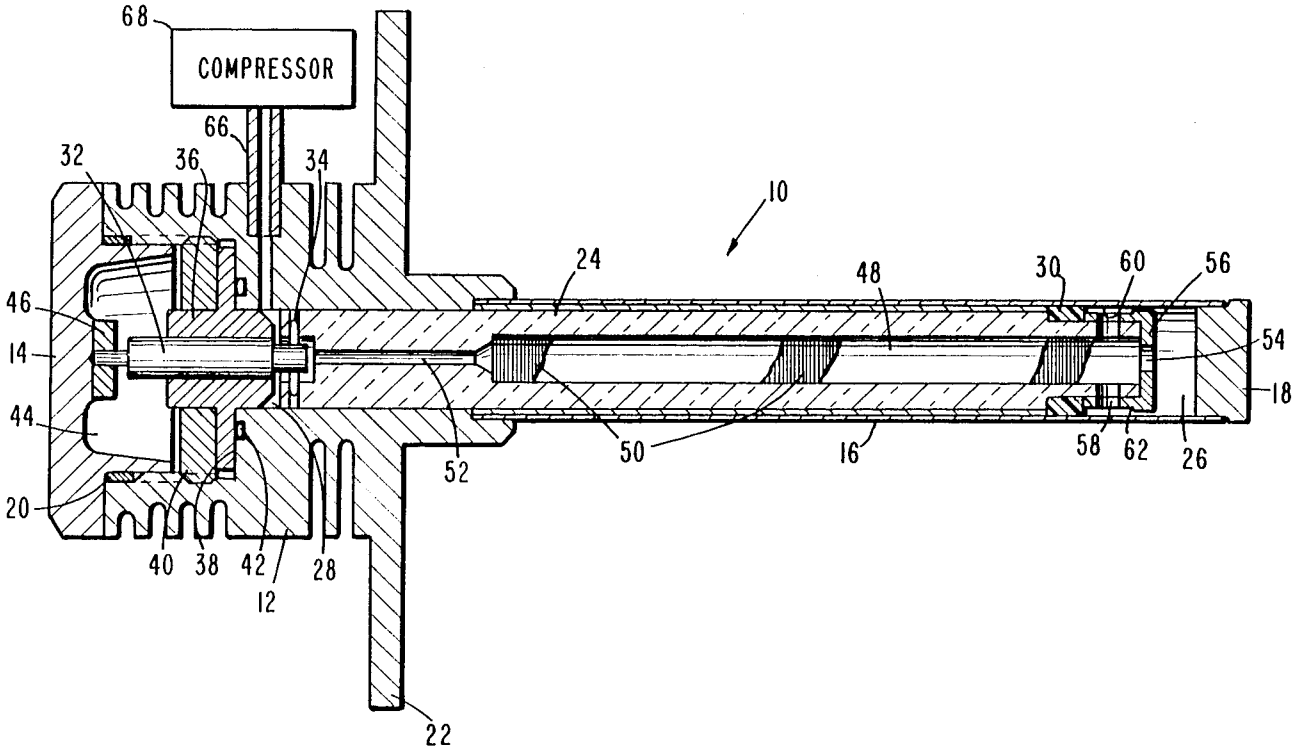
COMPRESSOR
10
12
14
16
18
20
22
24
26
28
30
32
34
36
38
40
42
44
46
48
50
52
54
56
58
60
62
66
68

CRYOGENIC REFRIGERATOR HAVING A REGENERATOR WITH PRIMARY AND SECONDARY FLOW PATHS

BACKGROUND OF THE INVENTION

1. Field of the Invention

This invention relates generally to refrigerators and more particularly to cryogenic coolers which employ regenerators.

2. Description of Related Art

Over the past several decades, compact cryogenic refrigerators have been developed to give reliable cryogenic temperatures from about 8° K. to 150° K. in very small spaces. Some of the more successful cryogenic refrigerators today employ thermal regenerators to accomplish the variety of refrigeration cycles such as the Stirling cycle, Split-stirling cycle, Gifford-McMahon cycle, Solvay cycle, pulse tube cycle and the Vuilleumier cycle. Thermal regenerators are typically incorporated into either a displacer or a piston which reciprocates within the particular refrigerator arrangement to accomplish one of these operating cycles.

For example, a conventional regenerative cryogenic refrigerator may have a displacer located within a fluid-tight enclosed chamber. The displacer divides this chamber into two smaller chambers, namely a warm chamber and a cold chamber. Within the displacer is a thermal regenerator which typically has a cylindrically-shaped bore containing a matrix of metallic screens therein, and opening at each end to the warm and cold chambers. Accordingly, gas may pass through the regenerator flowing from one chamber to the other.

In typical operation, the displacer/regenerator reciprocates back and forth within the fluid-tight enclosed chamber varying the volumes of the warm and cold chambers and passing gas therebetween. The cold chamber is the region where refrigeration occurs and is the location upon which devices to be cooled such as infrared sensors are mounted. To cool such devices, a high pressure fluid is introduced into the warm chamber and flows through the regenerator exiting into the cold chamber through a hole at the end of the displacer. The high pressure fluid is cooled as it passes through the regenerator. The displacer moves toward the warm end, increasing the volume of the cold chamber and simultaneously filling the cold chamber with more high pressure gas. Next, the pressure in the warm cold chambers is reduced, and accordingly the gas in the cold chamber is extracted back through the regenerator and exits into the warm chamber at about ambient temperature. The gas in the cold chamber therefore expands reducing the temperature of this gas. The cooled gas absorbs heat at the cold end before passing through the regenerators. Next, the displacer moves toward the cold chamber, decreasing the volume of the cold chamber which still contains low pressure gas. High pressure fluid is again introduced into the warm chamber which passes through the regenerator to the cold volume increasing the pressure in the cold chamber. This increase in cold chamber pressure increases the temperature of the gas therein. However, since more heat is taken from the cold chamber than put into it, a net refrigeration effect takes place in the cold chamber to provide the desired cooling.

Historically, the heat transfer path between the regenerator and cold chamber was accomplished by a hole at the end of the regenerator. The end hole directs the gas exiting the regenerator onto the end wall of the cold chamber. This technique provided efficient heat transfer at the cold end of the refrigerator, and is illustrated in U.S. Pat. Nos. 3,877,239 and 3,913,339, for example, which are assigned to the assignee herein. However, as larger cooling capacity refrigeration arrangements were developed and accordingly as refrigerators and their respective parts increased physically in size, the end hole did not provide for efficient heat transfer to the cold chamber. The end hole was replaced by radial holes located near the end of the displacer as exemplified in U.S. Pat. Nos. 3,218,815 and 3,303,658, for example. In refrigerators employing radial holes, gas exits the regenerator and impinges on the annular inner wall of the cold chamber. The gas is distributed over a larger surface of the cold chamber. Therefore, heat is transferred from the cold chamber walls over a larger area and with a larger heat transfer coefficient than was possible with the end hole.

Today refrigerators are being made smaller and smaller to meet size and weight requirements desired by both military and commercial customers. Furthermore, as miniature refrigerators are increasingly used to cool electronic devices in remote environments, high reliability, high efficiency and long maintenance-free life refrigerators are being demanded. In most present day refrigerators, a major source of loss of performance or failure results from the freezing of condensable contaminants blocking the passageway from the regenerator to the cold end. Although vigorous cleaning procedures, including pumping and baking, may be employed, undesirable amounts of condensable contaminants are still present within the refrigerator after filling with working fluid. Moreover, additional contaminants are generated by chemical reactions between component parts of the refrigerator. Presently no refrigeration arrangement has been realized to effectively deal with these contamination problems which have plagued the industry for many years.

SUMMARY OF THE INVENTION

It is therefore an object of the present invention to provide a cryogenic refrigerator having a much longer life than those available in the prior art.

It is a further object of the present invention to provide a cryogenic refrigerator which operates more reliably at relatively high ambient temperatures.

It is a feature of the present invention to provide both radial and end holes in a displacer or piston which much more readily prevents contaminants from clogging and blocking the flow of working fluid at the cold end of the refrigerator.

It is an advantage of the present invention that end and radial holes provide primary and secondary flow paths which increase the life of a cryogenic refrigerator by a factor of up to ten times or more at little additional cost to the refrigerator.

A cryogenic refrigerator according to the present invention includes a displacer (or a piston) having a regenerator matrix. At the cold end of the regenerator/-displacer are a plurality of radial holes and also an end hole which form the flow path between the regenerator and the cold chamber of the refrigerator.

Other and further objects, advantages and characteristic features of the present invention will become readily apparent from the following detailed description of preferred embodiments of the invention when taken in conjunction with the appended claims.

BRIEF DESCRIPTION OF THE DRAWINGS

The sole FIGURE is a cross-sectional side view of a cryogenic refrigerator in accordance with the invention.

DETAILED DESCRIPTION OF THE INVENTION

Referring now with greater particularity to the FIGURE, a cryogenic refrigerator 10 is shown having a fluid-tight enclosure including housing 12, housing end cap 14, elongated cylindrical tube 16 and plug 18. The housing end cap 14 is cylindrically shaped with annular fins about the exterior for heat transfer purposes. An axial hole extends through the housing 12 from one end to the other. Housing 12 further has a flange 22 which is typically used to attach the refrigerator 10 to a support member (not shown). The housing end cap 14 may be screwed into the threaded end of housing 12, a crush seal 20 being placed therebetween to form a fluid-tight seal. Cylindrical tube 16, which may be made of Inconel or other high strength material, may be brazed or otherwise joined to the other end of housing 12, the two parts forming together an elongated cylindrically-shaped chamber therein. Plug 18 seals the other end of cylindrical tube 16, typically being affixed thereto by brazing, for example. Plug 18 forms the cold end of the refrigerator and is typically made of a material which has high thermal conductivity at the refrigeration temperature, such as copper or nickel, for example. Devices, such as electronic sensors 17, to be refrigerated are typically attached to the plug 18.

Within the elongated cylindrical tube 16 and extending into the housing 12 is a displacer 24, which is free-floating. Nonfree-floating displacer arrangements, such as those with a mechanical spring attached, are also suitable and may be employed. Displacer 24 may be made of fiberglass impregnated with epoxy, for example. A displacer end cap 56 is slidably mounted over the end of displacer 24 nearest to the plug 18 and is bonded thereto by epoxy, for example. Displacer end cap 56 may be made of fiberglass, for example. The displacer 24 divides elongated chamber formed by the interior of the tube 16 into a cold volume 26 at the cold end of the tube 16 and a warm volume 28 located within housing 12. Rider 30, which may be a ring of Teflon or Rulon, for example, is mounted about the displacer 24 in an annular groove near the cold end of the displacer 24. Rider 30 forms a close fit with inner wall 60 of cylindrical tube 16, having typically 0.002 of an inch clearance therebetween, and thereby guides displacer 24 as it reciprocates back and forth within the tube 16.

Displacer 24 is connected at its end within housing 12 to plunger 32 by pin 34. Plunger 32 is reciprocally mounted within a bushing 36 which is held tightly against inner wall 38 of the housing 12 by nut 40. An O-ring 42 placed between bushing 36 and an annular notch in housing 38 seals off a third volume 44 from the warm volume 28. The third volume 44 my contain a pressurized gas which is partly responsible for the reciprocation of the displacer 24. Other means may be used to reciprocate the displacer such as a spring, or an electrical motor means, for example. Plunger 32 extends into the third volume 44, and has a rubber bumper 46 securely attached to the end thereof serving as a stop.

A regenerator 48 is located within the displacer 24. Regenerator 48 is a cylindrically shaped chamber which is typically filled with stainless steel disk-shaped screens 50 adjacently stacked together. The size of the screens will, of course, depend on the desired cooling capacity and speed of operation of the refrigerator. Other materials may also be employed to fill the regenerator chamber such as lead balls, or wire, for example.

At one end, the regenerator 48 opens through passageway 52 to the warm volume 28. At the other end, the regenerator 48 opens to the cold volume 26 through an end hole 54 which faces the end wall of the cold volume. The regenerator 48 further opens to the cold volume 26 through a plurality of radial holes 58 which face the annular inner wall 60 of cylindrical tube 16. A narrow annular passageway 62 between the outer wall at the cold end portion of the displacer 24 and the inner annular wall 60 of cylindrical tube 16 forms a fluid path from the radial holes to the cold volume 26. The radial holes 58 preferably have a total cross-sectional area approximately equal to that of the end hole 54, giving the radial holes and the end hole about the same total flow area. However, larger or smaller holes may be employed, depending upon the flow requirements of the particular refrigerator. Preferably, four to eight radial holes equally circumferentially spaced around the surface of tube 16 are employed.

A fluid actuated drive system such as a piston-driven compressor 68 is in fluid-tight communication with warm volume of the refrigerator via conduit 66. The compressor provides alternating pulses of high pressure fluid and low pressure fluid to the warm volume, and may be a rotary type or linear type compressor. During operation of the compressor, the third volume 44 is charged with the same refrigerant gas as the remainder of the system and is at the mean pressure of the warm volume 28. Leakage between the plunger 32 and the bushing 36 maintains the pressure in the third volume 44 at the mean pressure of warm volume 28. Upon a high pressure pulse from the compressor, high pressure gas enters the warm volume 28 and is cooled as it passes through the regenerator 48, exiting through the end hole 54 slightly above the refrigeration temperature at the cold end. The displacer 24 moves toward the warm volume 28, and accordingly the gas in the cold volume 26 expands, cooling the gas even more. The compressor pressure cycles from high to low, and the cooled gas from the cold volume 26 is extracted via passageway 52 in the regenerator 48 and exits therefrom into the warm volume 28. The temperature of gas in the warm volume 28 is above the ambient temperature surrounding housing 12, and therefore heat is drawn from the warm volume 28 through housing 12. The displacer 24 then moves toward the cold volume 26 putting a small amount of heat into the gas therein but less than was taken out. Thus, a net refrigeration effect is produced at the cold end 26 of the refrigerator 10.

In the aforedescribed process, the end hole 54 acts as the primary fluid flow path for the gas passing between the regenerator 48 and the cold volume 26. During the refrigeration operation, liquid contaminants are generated in the compressor due to reactions of greases and bearing material. This contaminant generation is most prevalent in rotary compressors but is nevertheless present but to a lesser degree in linear compressors. When the compressor is shut off, these liquid contaminants typically collect at the coldest portion of the refrigerator, i.e. at the area of the cold volume 26. In conventional refrigeration arrangements, these contaminants would build up at the end hole, such that the performance of the refrigerator degrades, and finally the refrigerator fails due to blocked flow of the working fluid.

The radial holes 58 in a refrigerator according to the invention serve as secondary fluid flow passageways and provide an alternate fluid flow path when the primary end hole 54 is blocked. In fact, the radial holes 58 surprisingly extend the life of the refrigerator up to ten times or more. It is recognized that in the prior art radial holes are not used in smaller refrigerators because they undesirably reduce the length of the regenerator and thereby reduce the efficiency of the refrigerator. However, any loss in performance is more than made up by the increased life to the refrigerator afforded by the secondary radial holes.

As a specific example, three cryogenic refrigerators constructed substantially as shown and described herein except without any radial holes 58 were tested for operating life. The three refrigerators were ¼ watt Split-stirling cycle cryocoolers employing a rotary compressor. All three refrigerators had a displacer with an outside diameter of about 0.185 inch. The regenerator chamber had a diameter of about 0.125 inch with an end hole of about 0.060 inch in diameter. The three units were subjected to harsh environmental conditions to accelerate life. In a 24 hour cycle, the three units were run for one hour at room temperature (about 24° C.), then for the next 22 hours at 55° C., then turned off for one hour. The units were continually test cycled in this manner until failure, wherein the unit failed to provide cooling. The three units failed, respectively, after 42, 48 and 24 hours of operation. The same three units were modified by adding four secondary radial holes of about 0.030 evenly circumferentially spaced about the displacer about 0.040 of an inch up from the end of the displacer. The three units were subjected to the same test conditions and lasted 438, 260 and 139 hours, respectively, an average increase in life of 7.3 with the best increase being more than 10 times.

Various modifications may be made to the above-described preferred embodiment without departing from the scope of the invention. For example, additional or fewer holes may be used of varying sizes and shapes. Moreover, although a refrigerator has been shown and described employing a displacer with a regenerator, the principles disclosed herein also apply to refrigerators having pistons with regenerators. Accordingly, it should be understood that although the invention has been shown and described for one particular embodiment, nevertheless various changes and modifications obvious to a person of ordinary skill in the art to which the invention pertains are deemed to lie within the spirit and scope of the invention as set forth in the following claims.

What is claimed is:

1. A cryogenic refrigerator comprising:

a tubular member having a cold end;

a substantially cylindrical displacer reciprocally mounted within said tubular member and separating said tubular member into a cold volume at said cold end and a warm volume at the other end of said tubular member;

said displacer defining a regeneration chamber therein in fluid communication between said warm volume and said cold volume, and further defining a hole in its end facing said cold end and a plurality of radially extending holes in its lateral surface a short distance from said end; and pressure response means for alternately urging said displacer toward the cold and the warm ends of said cylinder.

2. The cryogenic refrigerator defined in claim 1 wherein the cross-sectional area of said hole in said end is about the same as the total cross-sectional area of said radial holes.

3. The cryogenic refrigerator defined in claim 1 wherein said radial holes are equally circumferentially spaced around said displacer.

4. The cryogenic refrigerator defined in claim 3 wherein said plurality of passageways includes a plurality of radial holes in the range of four to eight.

5. The cryogenic refrigerator defined in claim 4 wherein said plurality of passageways includes one end hole and four radial holes.

6. The cryogenic refrigerator defined in claim 1 further comprising a compressor coupled to said warm volume.

7. The cryogenic refrigerator defined in claim 6 wherein said compressor is a rotary compressor.

8. The cryogenic refrigerator defined in claim 6 wherein said compressor is a linear compressor.

9. The cryogenic refrigerator defined in claim 1 further including a device to be cooled thermally attached to said cold end of said cylinder.

10. A cryogenic refrigerator, comprising:

a fluid-tight housing;

a plurality of chambers adapted to be maintained at different temperature levels within said housing;

a displacer reciprocally mounted within said housing for varying the volume of at least two of said plurality of chambers;

a regenerator located within said displacer connected to said at least two of said plurality of chambers, said regenerator having an axial hole at one end and a plurality of radial holes near said one end; and driving means for reciprocating said displacer such that said refrigerator is operated through a predetermined cycle.

11. The cryogenic refrigerator defined in claim 10 wherein said radial holes have a combined cross-sectional area about that of said one axial hole.

12. The cryogenic refrigerator defined in claim 11 wherein said plurality of radial holes is in the range of three to eight.

13. The cryogenic refrigerator defined in claim 12 wherein said plurality of radial holes is four.

14. The cryogenic refrigerator defined in claim 10 further including a device to be cooled thermally coupled to said fluid- tight housing.

15. A displacer for a cryogenic refrigerator, comprising:

an elongated cylindrically shaped member having two ends;

a regenerator located within said elongated cylindrically-shaped member and defining an elongated chamber with at least one opening at one end and at least one opening at the other end, and further defining a plurality of radial openings near said other end; and heat transfer means located within the elongated chamber of said regenerator.

16. The displacer defined in claim 15 wherein said heat transfer means is a plurality of adjacently stacked screens.

17. The displacer defined in claim 15 wherein said heat transfer means includes a plurality of closely packed thermally conductive balls.

18. The displacer defined in claim 15 wherein said plurality of radial openings is in the range of from about three to eight.

19. The displacer defined in claim 18 wherein said plurality of radial openings is four.

20. The displacer defined in claim 18 wherein the cross-sectional area of said end opening at said other end is about the same as the total cross-sectional area of said radial holes.

21. A refrigerator comprising:

a fluid-tight enclosure having an elongated chamber therein;

a displacer located in said elongated chamber dividing it into a cold volume and a warm volume, said displacer having a regenerator therein opening at one end to said warm volume and at the other end to said cold volume, the opening into said cold volume including an end hole and plurality of radial holes;

drive means coupled to said displacer for reciprocating said displacer; and means for supplying a fluid under pressure to said warm volume.

22. The refrigerator defined in claim 21 wherein said means for supplying fluid under pressure is a rotary compressor.

23. The refrigerator defined in claim 21 wherein said means for supplying fluid under pressure is a linear compressor.

24. The refrigerator defined in claim 21 further including a device to be refrigerated thermally attached to said fluid-tight enclosure adjacent said cold volume.

25. A cryogenic refrigerator, comprising:

a tubular member having a cold end;

a piston reciprocally mounted within said enclosure defining a cold volume at said cold end of said tubular member;

said piston defining a regenerative chamber therein in fluid communication with said cold volume defined by a hole in its end facing said cold end and a plurality of radially extending holes in its lateral surface a short distance from said end; and means for reciprocating said piston to vary the volume of said cold volume.

26. The cryogenic refrigerator defined in claim 25 wherein the cross-sectional area of said hole in said end is about the same s the total cross-sectional area of said radial holes.

27. The cryogenic refrigerator defined in claim 26 wherein said radial holes are equally circumferentially spaced around said displacer.

28. The cryogenic refrigerator defined in claim 25 further comprising a compressor coupled to said warm volume.

29. The cryogenic refrigerator defined in claim 28 wherein said compressor is a rotary compressor.

30. The cryogenic refrigerator defined in claim 29 wherein said compressor is a linear compressor.

* * * * *